US011434542B2

(12) United States Patent
Miyamoto et al.

(10) Patent No.: US 11,434,542 B2
(45) Date of Patent: Sep. 6, 2022

(54) HIGH-CARBON HOT-ROLLED STEEL SHEET AND METHOD FOR PRODUCING THE SAME

(71) Applicant: JFE Steel Corporation, Tokyo (JP)

(72) Inventors: Yuka Miyamoto, Tokyo (JP); Takashi Kobayashi, Tokyo (JP); Yasuhiro Sakurai, Tokyo (JP); Takeshi Yokota, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 16/964,627

(22) PCT Filed: Jan. 22, 2019

(86) PCT No.: PCT/JP2019/001856
§ 371 (c)(1),
(2) Date: Jul. 24, 2020

(87) PCT Pub. No.: WO2019/151048
PCT Pub. Date: Aug. 8, 2019

(65) Prior Publication Data

US 2021/0054477 A1 Feb. 25, 2021

(30) Foreign Application Priority Data

Jan. 30, 2018 (JP) ..... JP2018-013125

(51) Int. Cl.

| | |
|---|---|
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/60*** | (2006.01) |
| ***C21D 8/02*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |

(52) U.S. Cl.
CPC ..... *C21D 9/46* (2013.01); *C21D 8/0226* (2013.01); *C21D 8/0273* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/60* (2013.01); *C21D 2211/003* (2013.01); *C21D 2211/005* (2013.01)

(58) Field of Classification Search
CPC ..... C21D 9/46; C21D 2211/003; C21D 2211/005; C22C 38/001; C22C 38/02; C22C 38/04; C22C 38/06; C22C 38/60
USPC ..... 428/544
See application file for complete search history.

(56) References Cited

U.S. PATENT DOCUMENTS

| | | | |
|---|---|---|---|
| 10,400,299 | B2 | 9/2019 | Miyamoto et al. |
| 2009/0260729 | A1 | 10/2009 | Iizuka et al. |
| 2010/0282376 | A1 | 11/2010 | Kimura et al. |
| 2017/0121787 | A1 | 5/2017 | Miyamoto et al. |

FOREIGN PATENT DOCUMENTS

| | | | |
|---|---|---|---|
| CN | 101098979 | A | 1/2008 |
| CN | 101861406 | A | 10/2010 |
| CN | 102021493 | A | 4/2011 |
| CN | 104040000 | A | 9/2014 |
| CN | 105331895 | A | 2/2016 |
| EP | 2199422 | A1 | 6/2010 |
| EP | 2216422 | A1 | 8/2010 |
| EP | 2557185 | A1 | 2/2013 |
| EP | 2712944 | A1 | 4/2014 |
| EP | 2801636 | A1 | 11/2014 |
| EP | 3091097 | A1 | 11/2016 |
| JP | 2002060849 | A | 2/2002 |
| JP | 2005344194 | A | 12/2005 |

(Continued)

OTHER PUBLICATIONS

Okuda et al., WO2015146173 A1 machine translation, Mar. 26, 2015, entire machine translation (Year: 2015).*
Takeda et al., JP 2015117406 A machine translation, Jun. 25, 2015, entire translation (Year: 2015).*
International Search Report and Written Opinion for International Application No. PCT/JP2019/001856, dated Apr. 2, 2019, 5 pages.
Chinese Office Action for Chinese Application No. 201980010258.0, dated Apr. 28, 2021 with Concise Statement of Relevance of Office Action, 12 pages.
Extended European Search Report for European Application No. 19 748 045.2, dated Oct. 1, 2020, 7 pages.

*Primary Examiner* — Humera N. Sheikh
*Assistant Examiner* — Katherine A Christy
(74) *Attorney, Agent, or Firm* — RatnerPrestia

(57) ABSTRACT

A high-carbon hot-rolled steel sheet has a composition containing, on a percent by mass basis, C: 0.10% or more and less than 0.20%, Si: 0.5% or less, Mn: 0.25% to 0.65%, P: 0.03% or less, S: 0.010% or less, sol. Al: 0.10% or less, N: 0.0065% or less, Cr: 0.05% to 0.50%, and B: 0.0005% to 0.005%, the balance being Fe and incidental impurities, the high-carbon hot-rolled steel sheet having a microstructure containing ferrite and cementite, in which the percentage of the number of cementite grains having an equivalent circular diameter of 0.1 μm or less is 12% or less based on the total number of cementite grains, the amount of Cr dissolved in the steel sheet is 0.03% to 0.50%, and the high-carbon hot-rolled steel sheet has a hardness of 73 or less in terms of HRB and a total elongation of 37% or more.

16 Claims, No Drawings

(56) References Cited

FOREIGN PATENT DOCUMENTS

| | | | | |
|---|---|---|---|---|
| JP | 4012475 | B2 | 11/2007 | |
| JP | 2009299189 | A | 12/2009 | |
| JP | 2010255066 | A | 11/2010 | |
| JP | 2011202192 | A | 10/2011 | |
| JP | 5458649 | B2 | 4/2014 | |
| JP | 2015017283 | A | 1/2015 | |
| JP | 2015017284 | A | 1/2015 | |
| JP | 2015117406 | A | 6/2015 | |
| WO | 2007111080 | A1 | 10/2007 | |
| WO | 2015146173 | A1 | 10/2015 | |
| WO | WO-2015146173 | A1 * | 10/2015 | ..... C21D 8/0226 |

* cited by examiner

HIGH-CARBON HOT-ROLLED STEEL SHEET AND METHOD FOR PRODUCING THE SAME

CROSS REFERENCE TO RELATED APPLICATIONS

This is the U.S. National Phase application of PCT/JP2019/001856, filed Jan. 22, 2019, which claims priority to Japanese Patent Application No. 2018-013125, filed Jan. 30, 2018, the disclosures of these applications being incorporated herein by reference in their entireties for all purposes.

FIELD OF THE INVENTION

The present invention relates to a high-carbon hot-rolled steel sheet having good cold workability and good hardenability (immersion quenching properties and carburizing and quenching properties) and a method for producing the high-carbon hot-rolled steel sheet.

BACKGROUND OF THE INVENTION

Currently, automotive components, such as transmissions and seat recliners, are often produced by cold-working carbon steels for machine structural use specified in JIS G4051 and hot-rolled steel sheets (high-carbon hot-rolled steel sheets) serving as alloy steels for machine structural use into desired shapes and then subjecting the resulting articles to hardening treatment to ensure desired hardness. Thus, hot-rolled steel sheets serving as raw materials are required to have good cold workability and good hardenability. Various steel sheets have been reported so far.

For example, Patent Literature 1 discloses a high-carbon steel sheet for fine blanking, the steel sheet containing, on a percent by weight basis, C: 0.15% to 0.9%, Si: 0.4% or less, Mn: 0.3% to 1.0%, P: 0.03% or less, T. Al: 0.10% or less, one or more of Cr: 1.2% or less, Mo: 0.3% or less, Cu: 0.3% or less, and Ni: 2.0% or less, or Ti: 0.01% to 0.05%, B: 0.0005% to 0.005%, and N: 0.01% or less, and having a microstructure in which a carbide having a spheroidizing ratio of 80% or more and an average grain size of 0.4 to 1.0 μm is dispersed in ferrite.

Patent Literature 2 discloses a high-carbon steel sheet having improved workability and containing, on a percent by mass basis, C: 0.2% or more, Ti: 0.01% to 0.05%, and B: 0.0003% to 0.005%, a carbide having an average grain size of 1.0 μm or less, the percentage of the carbide having a grain size of 0.3 μm or less being 20% or less.

Patent Literature 3 discloses a steel for machine structural use, the steel having improved cold workability and improved decarburizing properties, containing, on a percent by mass basis, C: 0.10% to 1.2%, Si: 0.01% to 2.5%, Mn: 0.1% to 1.5%, P: 0.04% or less, S: 0.0005% to 0.05%, Al: 0.2% or less, Te: 0.0005% to 0.05%, N: 0.0005% to 0.03%, Sb: 0.001% to 0.05%, and one or more of Cr: 0.2% to 2.0%, Mo: 0.1% to 1.0%, Ni: 0.3% to 1.5%, Cu: 1.0% or less, and B: 0.005% or less, and having a microstructure mainly composed of ferrite and pearlite, the ferrite having a grain size index of 11 or more.

Patent Literature 4 discloses a high-carbon hot-rolled steel sheet having good hardenability and good workability, containing, on a percent by mass basis, C: 0.20% to 0.40%, Si: 0.10% or less, Mn: 0.50% or less, P: 0.03% or less, S: 0.010% or less, sol. Al: 0.10% or less, N: 0.005% or less, B: 0.0005% to 0.0050%, and 0.002% to 0.03% in total of one or more of Sb, Sn, Bi, Ge, Te, and Se, and having a microstructure composed of ferrite and cementite. The microstructure having a density of cementite in ferrite grains of 0.10 pieces/$\mu m^2$ or less, the steel sheet having a hardness of 75 or less in terms of HRB and a total elongation of 38% or more.

Patent Literature 5 discloses a high-carbon hot-rolled steel sheet having good hardenability and good workability, containing, on a percent by mass basis, C: 0.20% to 0.48%, Si: 0.10% or less, Mn: 0.50% or less, P: 0.03% or less, S: 0.010% or less, sol. Al: 0.10% or less, N: 0.005% or less, B: 0.0005% to 0.0050%, and 0.002% to 0.03% in total of one or more of Sb, Sn, Bi, Ge, Te, and Se, the steel sheet having a microstructure composed of ferrite and cementite. The microstructure having a cementite density in ferrite grains of 0.10 pieces/$\mu m^2$ or less, the steel sheet having a hardness of 65 or less in terms of HRB and a total elongation of 40% or more.

Patent Literature 6 discloses a high-carbon hot-rolled steel sheet containing, on a percent by mass basis, C: 0.20% to 0.40%, Si: 0.10% or less, Mn: 0.50% or less, P: 0.03% or less, S: 0.010% or less, sol. Al: 0.10% or less, N: 0.005% or less, B: 0.0005% to 0.0050%, and 0.002% to 0.03% in total of one or more of Sb, Sn, Bi, Ge, Te, and Se, the percentage of the amount of dissolved B being 70% or more based on the B content, the steel sheet having a microstructure composed of ferrite and cementite. The microstructure having a cementite density in ferrite grains of 0.08 pieces/$\mu m^2$ or less, the steel sheet having a hardness of 73 or less in terms of HRB and a total elongation of 39% or more.

Patent Literature 7 discloses a high-carbon hot-rolled steel sheet having a composition containing, on a percent by mass basis, C: 0.15% to 0.37%, Si: 1% or less, Mn: 2.5% or less, P: 0.1% or less, S: 0.03% or less, sol. Al: 0.10% or less, N: 0.0005% to 0.0050%, B: 0.0010% to 0.0050%, and 0.003% to 0.10% in total of at least one of Sb and Sn, the composition satisfying the relationship $0.50<(14[B])/(10.8[N])$, the balance being Fe and incidental impurities. The steel sheet having a microstructure composed of a ferrite phase and cementite. The microstructure having an average grain size of the ferrite phase of 10 μm or less and a spheroidizing ratio of cementite of 90% or more, the steel sheet having a total elongation of 37% or more.

CITATION LIST

Patent Literature

PTL 1: Japanese Unexamined Patent Application Publication No. 2009-299189

PTL 2: Japanese Unexamined Patent Application Publication No. 2005-344194

PTL 3: Japanese Patent No. 4012475

PTL 4: Japanese Unexamined Patent Application Publication No. 2015-017283

PTL 5: Japanese Unexamined Patent Application Publication No. 2015-017284

PTL 6: International Publication No. 2015/146173

PTL 7: Japanese Patent No. 5458649

SUMMARY OF THE INVENTION

The technique described in Patent Literature 1 relates to fine blanking quality, and the effect of the dispersion state of the carbide on fine blanking quality and hardenability is described. Patent Literature 1 states that the average carbide grain size is controlled to 0.4 to 1.0 μm and that the spheroidizing ratio is set to 80% or more, thereby providing a steel sheet having improved fine blanking quality and improved hardenability. However, there is no discussion about cold workability. Additionally, there is no description regarding carburizing and quenching properties.

The technique described in Patent Literature 2 focuses on the effect of the average carbide grain size and fine carbide grains having a size of 0.3 μm or less on workability. It is stated that a steel sheet having improved workability is obtained by controlling the average carbide grain size to 1.0 μm or less and controlling the percentage of carbide grains having a size of 0.3 μm or less to 20% or less. Although Patent Literature 2 describes a C content range of 0.20% or more, a C content range of less than 0.20% is not studied.

In the technique described in Patent Literature 3, it is stated that a steel having improved cold workability and improved resistance to decarburization is obtained by adjusting the component composition. However, there is no description of immersion quenching properties or carburizing and quenching properties in Patent Literature 3.

In the techniques described in Patent Literatures 4 to 6, it is stated as follows: The incorporation of 0.002% to 0.03% in total of B and one or more of Sb, Sn, Bi, Ge, Te, and Se is highly effective in preventing nitriding. For example, even if annealing is performed in a nitrogen atmosphere, nitriding is prevented. A predetermined amount of dissolved B is maintained to enhance hardenability. However, in all cases, the C content is 0.20% or more.

In the technique described in Patent Literature 7, a steel containing C: 0.15% to 0.37%, B, and one or more of Sb and Sn is reported to have high hardenability. However, higher hardenability, such as carburizing and quenching properties, is not studied.

In light of the foregoing problems, aspects of the present invention aim to provide a high-carbon hot-rolled steel sheet having good cold workability and good hardenability (immersion quenching properties and carburizing and quenching properties) and a method for producing the high-carbon hot-rolled steel sheet.

To achieve the object, the inventors have conducted intensive studies on the relationships among conditions for the production of a high-carbon hot-rolled steel sheet having a component composition containing Cr and B, preferably Ti and/or one or more of Sb and Sn in addition to Cr and B, cold workability, and hardenability (immersion quenching properties and carburizing and quenching properties) and have obtained the following findings.

i) The degree of hardness (hardness) and total elongation (hereinafter, also referred to simply as "elongation") of a high-carbon hot-rolled steel sheet before quenching are greatly affected by cementite grains having an equivalent circular diameter of 0.1 μm or less. In the case where the number of cementite grains having an equivalent circular diameter of 0.1 μm or less is 12% or less based on the total number of cementite grains, it is possible to obtain a hardness of 73 or less in terms of HRB and a total elongation (El) of 37% or more.

ii) In the case where annealing is performed in a nitrogen atmosphere, nitrogen is concentrated from the atmosphere into a steel sheet and binds to Cr and B in the steel sheet to form chromium nitride and boron nitride. This may decrease the amounts of Cr and B dissolved in the steel sheet. In accordance with aspects of the present invention, thus, in the case where annealing is performed in a nitrogen atmosphere, at least one of Sb and Sn is added to a steel sheet required to have higher hardenability (superior carburizing and quenching properties) in a predetermined amount. This prevents the nitriding and suppresses a decrease in the amount of dissolved Cr, so that higher hardenability (superior carburizing and quenching properties) can be ensured.

iii) A predetermined microstructure can be ensured by after hot rough rolling and finish rolling at a finishing temperature of $Ar_3$ transformation point or higher, cooling to 700° C. at an average cooling rate of 20 to 100° C./sec, coiling at a coiling temperature of higher than 580° C. to 700° C., and then holding at a temperature lower than $Ac_1$ transformation point. Alternatively, the predetermined microstructure can be ensured by a two-stage annealing including, after the coiling, heating to a temperature of the $Ac_1$ transformation point or higher and $Ac_3$ transformation point or lower, holding at the temperature for 0.5 hours or more, then cooling to a temperature lower than $Ar_1$ transformation point at an average cooling rate of 1 to 20° C./h, and holding at a temperature lower than $Ar_1$ transformation point for 20 hours or more.

These findings have led to the completion of the present invention. Aspects of the present invention are described below.

[1] A high-carbon hot-rolled steel sheet has a composition containing, on a percent by mass basis, C: 0.10% or more and less than 0.20%, Si: 0.5% or less, Mn: 0.25% to 0.65%, P: 0.03% or less, S: 0.010% or less, sol. Al: 0.10% or less, N: 0.0065% or less, Cr: 0.05% to 0.50%, and B: 0.0005% to 0.005%, the balance being Fe and incidental impurities, the high-carbon hot-rolled steel sheet having a microstructure containing ferrite and cementite, in which a percentage of a number of cementite grains having an equivalent circular diameter of 0.1 μm or less is 12% or less based on a total number of the cementite grains, the amount of Cr dissolved in the steel sheet is 0.03% to 0.50%, and the high-carbon hot-rolled steel sheet has a hardness of 73 or less in terms of HRB and a total elongation of 37% or more.

[2] The high-carbon hot-rolled steel sheet described in [1] further contains, on a percent by mass basis, Ti: 0.06% or less.

[3] The high-carbon hot-rolled steel sheet described in [1] or [2] further contains, on a percent by mass basis, 0.002% to 0.03% in total of at least one of Sb and Sn.

[4] In the high-carbon hot-rolled steel sheet described in any one of [1] to [3], the ferrite has an average grain size of 5 to 15 μm.

[5] The high-carbon hot-rolled steel sheet described in any one of [1] to [4] further contains, on a percent by mass basis, one or two or more of Nb: 0.0005% to 0.1%, Mo: 0.0005% to 0.1%, Ta: 0.0005% to 0.1%, Ni: 0.0005% to 0.1%, Cu: 0.0005% to 0.1%, V: 0.0005% to 0.1%, and W: 0.0005% to 0.1%.

[6] A method for producing a high-carbon hot-rolled steel sheet described in any one of [1] to [5] which includes subjecting a steel to hot rough rolling and to finish rolling at a finishing temperature of $Ar_3$ transformation point or higher, then cooling to 700° C. at an average cooling rate of 20 to 100° C./sec, coiling at a coiling temperature of higher than 580° C. to 700° C. and, after cooling to normal temperature, holding at an annealing temperature lower than $Ac_1$ transformation point.

[7] A method for producing a high-carbon hot-rolled steel sheet described in any one of [1] to [5] which includes subjecting a steel to hot rough rolling and to finish rolling at a finishing temperature of $Ar_3$ transformation point or higher, cooling to 700° C. at an average cooling rate of 20 to 100° C./sec, coiling at a coiling temperature of higher than 580° C. to 700° C. and, after cooling to normal temperature, heating to a temperature of $Ac_1$ transformation point or higher and $Ac_3$ transformation point or lower and holding at the temperature for 0.5 hours or more, cooling to a temperature lower than $Ar_1$ transformation point at an average cooling rate of 1 to 20° C./h, and holding at a temperature lower than the $Ar_1$ transformation point for 20 hours or more.

According to aspects of the present invention, a high-carbon hot-rolled steel sheet having good cold workability and hardenability (immersion quenching properties and carburizing and quenching properties) is provided. The use of the high-carbon hot-rolled steel sheet produced in accordance with aspects of the present invention as material steel sheets for automotive components, such as seat recliners, door latches, and driving systems, which require sufficient cold workability contributes significantly to the production of automotive components required to have stable quality. Thereby, industrially particularly advantageous effects are provided.

DETAILED DESCRIPTION OF EMBODIMENTS OF THE INVENTION

A high-carbon hot-rolled steel sheet according to aspects of the present invention and a method for producing the high-carbon hot-rolled steel sheet will be described in detail below.

1) Component Composition

The component composition of the high-carbon hot-rolled steel sheet according to aspects of the present invention and the reason for the limitation will be described below. In the following description, each component content of the component composition is expressed in units of "%" that refers to "% by mass" unless otherwise specified.

C: 0.10% or More and Less than 0.20%

C is an element important to achieve the strength after quenching. At a C content of less than 0.10%, a desired hardness is not obtained by heat treatment after forming. Thus, the C content needs to be 0.10% or more. However, a C content of 0.20% or more causes hardening, thereby deteriorating the toughness and the cold workability. Accordingly, the C content is 0.10% or more and less than 0.20%. In the case where the steel sheet is used for cold working of components that have complex shapes and that are not easily formed by pressing, the C content is preferably 0.18% or less, more preferably less than 0.15%.

Si: 0.5% or Less

Si is an element that increases the strength through solid-solution hardening. A higher Si content results in a higher hardness to deteriorate cold workability. Thus, the Si content is 0.5% or less, preferably 0.45% or less, more preferably 0.40% or less.

Mn: 0.25% to 0.65%

Mn is an element that improves the hardenability and increases the strength through solid-solution hardening. At a Mn content of less than 0.25%, both of the immersion quenching properties and the carburizing and quenching properties begin to deteriorate. Thus, the Mn content is 0.25% or more, preferably 0.30% or more. At a Mn content of more than 0.65%, a band structure due to Mn segregation is developed to lead to an uneven structure. Furthermore, the steel is hardened through solid-solution hardening to deteriorate cold workability. Accordingly, the Mn content is 0.65% or less, preferably 0.55% or less.

P: 0.03% or Less

P is an element that increases the strength through solid-solution hardening. An increase in P content to more than 0.03% leads to grain boundary embrittlement to deteriorate the toughness after quenching. Furthermore, the cold workability is deteriorated. Accordingly, the P content is 0.03% or less. To obtain good toughness after quenching, the P content is preferably 0.02% or less. P deteriorates the cold workability and the toughness after quenching. Thus, the P content is preferably minimized. However, the excessive reduction of P increases refining costs. Accordingly, the P content is preferably 0.005% or more, more preferably 0.007% or more.

S: 0.010% or Less

S forms sulfides to deteriorate the cold workability of a high-carbon hot-rolled steel sheet and the toughness after quenching, and thus is an element that should be minimized. A S content of more than 0.010% results in significant deteriorations in the cold workability of the high-carbon hot-rolled steel sheet and the toughness after quenching. Accordingly, the S content is 0.010% or less. To obtain good cold workability and the toughness after quenching, the S content is preferably 0.005% or less. S deteriorates the cold workability and the toughness after quenching. Thus, the S content is preferably minimized. However, the excessive reduction of S increases refining costs. Accordingly, the S content is preferably 0.0005% or more.

Sol. Al: 0.10% or Less

At a sol. Al content of more than 0.10%, AlN is formed during heating in quenching treatment to excessively reduce the size of austenite grains. This promotes the formation of a ferrite phase during cooling to lead to a microstructure composed of ferrite and martensite, thereby decreasing the hardness after quenching. Accordingly, the sol. Al content is 0.10% or less, preferably 0.06% or less. Note that sol. Al has a deoxidation effect. To sufficiently perform deoxidation, the sol. Al content is preferably 0.005% or more.

N: 0.0065% or Less

A N content of more than 0.0065% results in the formation of AlN to lead to an excessive reduction in the size of austenite grains during heating in quenching treatment. The formation of a ferrite phase is promoted during cooling to decrease the hardness after quenching. Accordingly, the N content is 0.0065% or less, preferably 0.0060% or less, more preferably 0.0050% or less. The lower limit of the N content is not particularly specified. N is an element that forms AlN, a chromium-containing nitride, and boron nitride to appropriately inhibit the growth of austenite grains during heating in quenching treatment, thereby improving the toughness after quenching. Accordingly, the N content is preferably 0.0005% or more.

Cr: 0.05% to 0.50%

Cr is an important element that enhances the hardenability in accordance with aspects of the present invention. At a Cr content of less than 0.05%, the effect is not sufficiently provided. Thus, the Cr content needs to be 0.05% or more. In the case where the steel has a Cr content of less than 0.05%, ferrite is easily formed at a surface layer, in particular, in carburizing and quenching, and a completely hardened microstructure is not obtained, thereby decreasing the hardness. From the viewpoint of achieving high hardenability, the Cr content is preferably 0.10% or more. At a Cr content of more than 0.50%, a steel sheet before quenching is hardened to deteriorate cold workability. Thus, the Cr content is 0.50% or less. In the case of forming a component that is not easily formed by pressing and that is required to be subjected to severe forming, even better cold workability is needed. Thus, the Cr content is preferably 0.45% or less, more preferably 0.35% or less.

B: 0.0005% to 0.005%

B is an important element that enhances the hardenability in accordance with aspects of the present invention. At a B content of less than 0.0005%, the effect is not sufficiently provided. Thus, the B content needs to be 0.0005% or more, preferably 0.0010% or more. At a B content of more than 0.005%, the recrystallization of austenite after finish rolling is delayed to develop the texture of the hot-rolled steel sheet, thus increasing the anisotropy after annealing. Thus, earing occurs easily in drawing. Accordingly, the B content is 0.005% or less, preferably 0.004% or less.

In accordance with aspects of the present invention, the remainder other than those described above is Fe and incidental impurities.

Owing to the foregoing essential elements, the high-carbon hot-rolled steel sheet according to aspects of the present invention can obtain the intended properties. To further improve the strength (hardness), cold workability, and hardenability, the high-carbon hot-rolled steel sheet according to aspects of the present invention may contain elements described below, as needed.

Ti: 0.06% or Less

Ti is an element effective in enhancing the hardenability. In the case where the incorporation of only Cr and B leads to insufficient hardenability, the hardenability can be improved by the incorporation of Ti. At a Ti content of less than 0.005%, the effect is not provided. Thus, if Ti is contained, the Ti content is 0.005% or more, more preferably 0.007% or more. At a Ti content of more than 0.06%, a steel sheet before quenching is hardened to deteriorate cold workability. Thus, when Ti is contained, the Ti content is 0.06% or less, preferably 0.04% or less.

At Least One of Sb and Sn: 0.002% to 0.03% in Total

Sb and Sn are elements effective in inhibiting nitriding from the surface layers of the steel sheet. When the total of one or more of these elements is less than 0.002%, the effect is not sufficiently provided. Thus, when at least one of Sb and Sn is contained, it is contained in an amount of 0.002% or more in total, preferably 0.005% or more. Even if one or more of these elements are contained in an amount of more than 0.03% in total, the effect of preventing nitriding is saturated. These elements tend to segregate at grain boundaries. Thus, when at least one of Sb and Sn is contained in an amount of more than 0.03% in total, grain boundary embrittlement may occur because of an excessively large amount contained. Accordingly, when at least one of Sb and Sn is contained, the total amount of these elements contained is 0.03% or less, preferably 0.02% or less.

In accordance with aspects of the present invention, at least one of Sb and Sn is contained in a total amount of 0.002% to 0.03%. Thus, even when annealing is performed in a nitrogen atmosphere, nitriding from the surface layers of the steel sheet is suppressed, thereby suppressing an increase in nitrogen concentration in the surface layers of the steel sheet. As described above, according to aspects of the present invention, nitriding from the surface layers of the steel sheet can be suppressed. Thus, even when annealing is performed in a nitrogen atmosphere, appropriate amounts of dissolved Cr and B can be ensured in the steel sheet after the annealing. This can provide high hardenability.

To further stabilize the mechanical properties and the hardenability in accordance with aspects of the present invention, at least one or more of Nb, Mo, Ta, Ni, Cu, V, and W may be incorporated in amounts required.

Nb: 0.0005% to 0.1%

Nb is an element that forms a carbonitride and that is effective in preventing exaggerated grain growth during heating before quenching, improving the toughness, and improving resistance to temper softening. At a Nb content of less than 0.0005%, the effect of the incorporation of Nb is not sufficiently provided. Thus, the lower limit is preferably 0.0005%. At a Nb content of more than 0.1%, the effect of the incorporation of Nb is saturated. Furthermore, a niobium carbide increases the tensile strength of the matrix material to decrease the elongation. Thus, the upper limit is preferably 0.1%, more preferably 0.05% or less, most preferably less than 0.03%.

Mo: 0.0005% to 0.1%

Mo is an element effective in improving the hardenability and the resistance to temper softening. A Mo content of less than 0.0005% results in a small effect of addition. Thus, the lower limit is 0.0005%. A Mo content of more than 0.1% results in the saturation of the effect of addition and an increase in cost. Thus, the upper limit is 0.1%, more preferably 0.05% or less, most preferably less than 0.03%.

Ta: 0.0005% to 0.1%

Similarly to Nb, Ta is an element that forms a carbonitride and that is effective in preventing exaggerated grain growth during heating before quenching, preventing the coarsening of grains, and improving the resistance to temper softening. A Ta content of less than 0.0005% results in a small effect of addition. Thus, the lower limit is 0.0005%. A Ta content of more than 0.1% results in the saturation of the effect of addition, an increase in cost, and a decrease in hardness after quenching due to excessive formation of carbide. Thus, the upper limit is 0.1%, more preferably 0.05% or less, most preferably less than 0.03%.

Ni: 0.0005% to 0.1%

Ni is an element highly effective in improving the toughness and hardenability. A Ni content of less than 0.0005% results in no effect of addition. Thus, the lower limit is 0.0005%. A Ni content of more than 0.1% results in the saturation of the effect of addition and an increase in cost. Thus, the upper limit is 0.1%, preferably 0.05% or less.

Cu: 0.0005% to 0.1%

Cu is an element effective in ensuring hardenability. At a Cu content of less than 0.0005%, the effect of addition is not sufficiently provided. Thus, the lower limit is 0.0005%. At a Cu content of more than 0.1%, flaws occur easily during hot rolling, thereby decreasing the productivity, such as the yield. Thus, the upper limit is 0.1%, preferably 0.05% or less.

V: 0.0005% to 0.1%

Similarly to Nb and Ta, V is an element that forms a carbonitride and that is effective in preventing exaggerated grain growth during heating before quenching, improving the toughness, and improving resistance to temper softening. At a V content of less than 0.0005%, the effect of addition is not sufficiently provided. Thus, the lower limit is 0.0005%. At a V content of more than 0.1%, the effect of addition is saturated. Furthermore, a V carbide increases the tensile strength of the matrix material to decrease the elongation. The upper limit is 0.1%, more preferably 0.05% or less, most preferably less than 0.03%.

W: 0.0005% to 0.1%

Similarly to Nb and V, W is an element that forms a carbonitride and that is effective in preventing exaggerated grain growth during heating before quenching and improving the resistance to temper softening. A W content of less than 0.0005% results in a small effect of addition. Thus, the lower limit is 0.0005%. A W content of more than 0.1% results in the saturation of the effect of addition, an increase in cost, and a decrease in hardness after quenching due to excessive formation of carbide. Thus, the upper limit is 0.1%, more preferably 0.05% or less, most preferably less than 0.03%.

2) Microstructure

The reason for the limitation of the microstructure of the high-carbon hot-rolled steel sheet according to aspects of the present invention will be described.

The microstructure in accordance with aspects of the present invention is composed of ferrite and cementite. Furthermore, the percentage of cementite grains having an equivalent circular diameter of 0.1 μm or less is 12% or less based on the total number of cementite grains, and the amount of Cr dissolved in the steel sheet is 0.03% to 0.50%. The ferrite preferably has an average grain size of 5 to 15 μm in accordance with aspects of the present invention.

The area percentage of ferrite is preferably 85% or more in accordance with aspects of the present invention. At an area percentage of ferrite of less than 85%, formability can be deteriorated to make it difficult to perform cold working for a component produced by severe forming. Thus, the area percentage of ferrite is preferably 85% or more.

2-1) Percentage of Cementite Grains Having Equivalent Circular Diameter of 0.1 μm or Less is 12% or Less Based on Total Number of Cementite Grains When the number of cementite grains having an equivalent circular diameter of 0.1 μm or less is large, the hardness is increased by dispersion strengthening to decrease the elongation. Because the percentage of the number of cementite grains having an equivalent circular diameter of 0.1 μm or less is 12% or less based on the total number of cementite grains in accordance with aspects of the present invention, it is possible to achieve a hardness of 73 or less in terms of HRB and a total elongation (El) of 37% or more. In view of cold workability, the percentage of the number of cementite grains having an equivalent circular diameter of 0.1 μm or less is preferably 10% or less based on the total number of cementite grains. The reason the percentage of the number of cementite grains having an equivalent circular diameter of 0.1 μm or less is defined is that the cementite grains having an equivalent circular diameter of 0.1 μm or less causes dispersion strengthening and thus an increase in the number of cementite grains having the size impedes the cold workability.

The cementite grains present before quenching have an equivalent circular diameter of about 0.07 to about 1.0 μm. Thus, the dispersion state of cementite grains having an equivalent circular diameter of more than 0.1 μm, which does not significantly affect precipitation strengthening, before quenching is not particularly specified in accordance with aspects of the present invention.

In the microstructure of the high-carbon hot-rolled steel sheet according to aspects of the present invention, the residual microstructure containing, for example, pearlite and bainite may be formed in addition to the ferrite and the cementite. When the total area percentage of the residual microstructure is 5% or less, the residual microstructure may be contained because the advantageous effects according to aspects of the present invention are not impaired.

2-2) Amount of Cr Dissolved in Steel Sheet: 0.03% to 0.50%

In immersion quenching in which the cooling rate is low, from the viewpoint of ensuring the microstructure that has been quenched to the middle portion of the sheet in the thickness direction even for a thick material, the ferrite transformation nose illustrated in a continuous cooling transformation diagram needs to be located at the longer-time side as much as possible. Cr dissolves easily in cementite and has a low diffusion rate in steel. Thus, once Cr dissolves in cementite, it is difficult to uniformly dissolve Cr even if heating is performed to the austenite range at the time of quenching. Thus, when the amount of Cr dissolved in the steel sheet, i.e., the dissolved Cr content of the steel sheet, is 0.03% or more, it is possible to provide good immersion quenching properties and good carburizing and quenching properties. Accordingly, the amount of dissolved Cr is 0.03% or more, preferably 0.12% or more. An increase in the amount of dissolved Cr slows down the spheroidization of cementite to prolong the annealing time, thereby decreasing the productivity. Thus, the amount of dissolved Cr is 0.50% or less. Preferably, the amount dissolved of Cr is 0.30% or less.

2-3) Average Grain Size of Ferrite: 5 to 15 μm (Preferred Condition)

When ferrite has an average grain size of less than 5 μm, the strength before cold working is increased to deteriorate press formability. Thus, the ferrite preferably has an average grain size of 5 μm or more. When ferrite has an average grain size of more than 15 μm, the strength of the matrix material is decreased. In a field where a steel sheet is formed into an intended product shape and used without quenching, the matrix material needs to have some strength. Thus, ferrite preferably has an average grain size of 15 μm or less, more preferably 6 μm or more, even more preferably 12 μm or less.

The equivalent circular diameter of cementite, the area percentage of ferrite, the amount of dissolved Cr, and the average grain size of ferrite can be measured by methods described in examples below.

3) Mechanical Properties

The high-carbon hot-rolled steel sheet according to aspects of the present invention is formed into automotive components, such as gears, transmissions, and seat recliners, by cold pressing and thus is required to have good cold workability. In addition, it is necessary to increase the hardness by quenching treatment to impart abrasion resistance. Thus, the high-carbon hot-rolled steel sheet according to aspects of the present invention has a reduced hardness of 73 or less in terms of HRB and an increased total elongation (El) of 37% or more and thus can has both of good cold workability and good hardenability (immersion quenching properties and carburizing and quenching properties).

The hardness (HRB) and the total elongation (El) described above can be measured by methods described in the examples below.

4) Production Method

The high-carbon hot-rolled steel sheet according to aspects of the present invention is produced by subjecting a steel material having a composition as described above to hot rough rolling and to finish rolling at a finishing temperature of $Ar_3$ transformation point or higher, then cooling to 700° C. at an average cooling rate of 20 to 100° C./sec, coiling at a coiling temperature of higher than 580° C. to 700° C. and, after cooling to normal temperature, annealing by holding at a temperature lower than $Ac_1$ transformation point. Alternatively, the high-carbon hot-rolled steel sheet according to aspects of the present invention is produced by subjecting a steel material having a composition as described above to hot rough rolling and to finish rolling at a finishing temperature of the $Ar_3$ transformation point or higher, then cooling to 700° C. at an average cooling rate of 20 to 100° C./sec, coiling at a coiling temperature of higher than 580° C. to 700° C. and, after cooling to normal temperature, performing two-stage annealing including heating to a temperature of the $Ac_1$ transformation point or higher and $Ac_3$ transformation point or lower and holding at the temperature for 0.5 hours or more, cooling to a temperature lower than $Ar_1$ transformation point at an average cooling rate of 1 to 20° C./h, and holding at a temperature lower than $Ar_1$ transformation point for 20 hours or more.

The reason for limitation in the method for producing a high-carbon hot-rolled steel sheet according to aspects of the present invention will be described below. In the description, the expression "° C." regarding temperature indicates a temperature at a surface of a steel sheet or a surface of a steel material.

In accordance with aspects of the present invention, a method for producing a steel material need not be particularly limited. For example, in order to refine a high-carbon steel according to aspects of the present invention, both a converter and an electric furnace can be used. A high-carbon steel refined by a known method of, for example, a converter is subjected to ingot making-slabbing or continuous casting into, for example, a slab (steel material). Typically, the slab is heated and then subjected to hot rolling (hot rough rolling and finish rolling).

For example, in the case of a slab produced by continuous casting, the slab may be direct rolled as it is or while being heated for the purpose of suppressing temperature drop. In the case where the slab is heated and hot-rolled, the heating temperature of the slab is preferably 1,280° C. or lower in order to avoid the deterioration of the surface state due to scale. In the hot rolling, the material to be rolled may be heated with a heating unit, such as a sheet bar heater, during the hot rolling in order to ensure a finishing temperature.

Finishing Temperature: Finish Rolling at $Ar_3$ Transformation Point or Higher

When the finishing temperature is lower than the $Ar_3$ transformation point, coarse ferrite grains are formed to significantly decrease the elongation after the hot rolling and the annealing. Thus, the finishing temperature is $Ar_3$ transformation point or higher, preferably ($Ar_3$ transformation point+20° C.) or higher. The upper limit of the finishing temperature need not be particularly limited. To smoothly perform cooling after the finish rolling, the upper limit is preferably 1,000° C. or lower.

The $Ar_3$ transformation point can be determined by actual measurement of thermal expansion measurement or electric resistance measurement during cooling by, for example, Formaster testing.

After Finish Rolling, Cooling to 700° C. at Average Cooling Rate of 20 to 100° C./sec After the finish rolling, the average cooling rate to 700° C. affects the amount of Cr dissolved in the steel sheet after coiling. In the annealing step after the coiling, dissolved Cr dissolves partially into cementite. Thus, in the step after the coiling, a predetermined amount of dissolved Cr needs to be ensured. To address it, after the finish rolling, the cooling needs to be performed at an average cooling rate of 20° C./sec or more. At an average cooling rate of less than 20° C./sec, the dissolved Cr present after the finish rolling dissolves into cementite, thus failing to obtain the predetermined amount of dissolved Cr. The average cooling rate is preferably 25° C./sec or more. An average cooling rate of more than 100° C./sec makes it difficult to obtain cementite having a predetermined size after annealing. Thus, the average cooling rate is 100° C./sec or less.

Coiling Temperature: Higher than 580° C. to 700° C.

The hot-rolled steel sheet after the finish rolling is wound into a coil shape. An excessively high coiling temperature may result in a hot-rolled steel sheet having insufficient strength to cause the resulting coil to be deformed by its own weight when wound into the coil shape. It is not preferable from the viewpoint of operation. Thus, the upper limit of the coiling temperature is 700° C., preferably 690° C. or lower. An excessively low coiling temperature results in the hardening of the hot-rolled steel sheet and thus is not preferred. Thus, the lower limit of the coiling temperature is higher than 580° C., preferably 600° C. or higher.

After winding into the coil shape, the coil may be cooled to normal temperature and subjected to pickling treatment. After the pickling, an annealing is performed.

Annealing Temperature: Holding at Lower than $Ac_1$ Transformation Point

The hot-rolled steel sheet produced as described above is subjected to annealing (annealing for the spheroidization of cementite). At an annealing temperature of the $Ac_1$ transformation point or higher, austenite is precipitated to form a coarse pearlite microstructure during the cooling process after the annealing, thereby leading to an uneven microstructure. Thus, the annealing temperature is lower than the $Ac_1$ transformation point, preferably ($Ac_1$ transformation point−10° C.) or lower. The lower limit of the annealing temperature is not particularly specified. To obtain a predetermined dispersion state of cementite, the annealing temperature is preferably 600° C. or higher, more preferably 700° C. or higher. As an atmosphere gas, any of nitrogen, hydrogen, and a gas mixture of nitrogen and hydrogen can be used. The holding time in the annealing is preferably 0.5 to 40 hours. When the holding time at the annealing temperature is less than 0.5 hours, the effect of the annealing is insufficient, and the target microstructure according to aspects of the present invention is not obtained, thereby failing to obtain the target hardness and elongation of the steel sheet according to aspects of the present invention. Accordingly, the holding time at the annealing temperature is preferably 0.5 hours or more, more preferably 5 hours or more. When the holding time at the annealing temperature is more than 40 hours, the productivity is decreased to lead to excessively high production costs. Thus, the holding time at the annealing temperature is preferably 40 hours or less, more preferably 35 hours or less.

After the coiling, the hot-rolled steel sheet can also be produced by a two-stage annealing including heating to a temperature of the $Ac_1$ transformation point or higher and the $Ac_3$ transformation point or lower, holding for 0.5 hours or more (first-stage annealing), cooling to a temperature lower than the $Ar_1$ transformation point at an average cooling rate of 1 to 20° C./h, and holding at the temperature lower than the $Ar_1$ transformation point for 20 hours or more (second-stage annealing).

In accordance with aspects of the present invention, the hot-rolled steel sheet is heated to the $Ac_1$ transformation point or higher and held for 0.5 hours or more to dissolve relatively fine carbide precipitated in the hot-rolled steel sheet into a γ phase. Then the steel sheet is cooled to a temperature lower than the $Ar_1$ transformation point at an average cooling rate of 1 to 20° C./h and held at the temperature lower than the $Ar_1$ transformation point for 20 hours or more to precipitate dissolved C by using, for example, relatively coarse undissolved carbide as a nucleus. Thereby, the dispersion state of the carbide (cementite) can be controlled in such a manner that the percentage of the number of cementite grains having an equivalent circular diameter of 0.1 μm or less is 12% or less based on the total number of cementite grains. In accordance with aspects of the present invention, the two-stage annealing is performed under the predetermined conditions to control the dispersion state of the carbide, thereby softening the steel sheet. In the high-carbon steel sheet targeted in accordance with aspects of the present invention, it is important to control the dispersion state of the carbide after annealing for softening. In accordance with aspects of the present invention, the high-carbon hot-rolled steel sheet is heated to the $Ac_1$ transformation point or higher and the $Ac_3$ transformation point or lower and held (first-stage annealing), thereby dissolving fine carbide and dissolving C into γ (austenite). In the subsequent cooling and holding stage (second-stage annealing) at the temperature lower than the $Ar_1$ transformation point, the α/γ interface and undissolved carbide present in a temperature range of the $Ac_1$ transformation point or higher serve as nucleation sites to precipitate relatively coarse carbide. Conditions for the two-stage annealing will be described below. As an atmosphere gas during the annealing, any of nitrogen hydrogen, and a gas mixture of nitrogen and hydrogen may be used.

Heating to Temperature of $Ac_1$ Transformation Point or Higher and $Ac_3$ Transformation Point or Lower and Holding for 0.5 Hours or More (First-Stage Annealing)

By heating the hot-rolled steel sheet to an annealing temperature of the $Ac_1$ transformation point or higher, a portion of ferrite in the microstructure of the steel sheet is transformed into austenite, fine carbide precipitated in ferrite is dissolved, and C is dissolved in the austenite. Ferrite that is not transformed into austenite and that remains untransformed is annealed at a high temperature. As a result, dislocation density in the ferrite is reduced and the ferrite is softened. Undissolved relatively coarse carbide (undissolved carbide) remains in ferrite and is further coarsened through Ostwald growth. When the annealing temperature is lower than the $Ac_1$ transformation point, austenite transformation does not occur, thus failing to dissolve carbide in austenite. In accordance with aspects of the present invention, when the holding time at the $Ac_1$ transformation point or higher is less than 0.5 hours, fine carbide cannot be sufficiently dissolved. Thus, as the first-stage annealing, the steel sheet is heated to the $Ac_1$ transformation point or higher and held for 0.5 hours or more. When the first-stage annealing temperature is higher than the $Ac_3$ transformation point, a large number of rod-like cementite grains are formed after the annealing to fail to obtain a predetermined elongation. Thus, the first-stage annealing temperature is the $Ac_3$ transformation point or lower. The holding time is preferably 10 hours or less.

Cooling to Lower than $Ar_1$ Transformation Point at Average Cooling Rate of 1 to 20° C./h After the first-stage annealing described above, the steel sheet is cooled to a temperature lower than the $Ar_1$ transformation point, which is within the temperature range of the second-stage annealing, at an average cooling rate of 1 to 20° C./h. During the cooling, C ejected from austenite by austenite→ferrite transformation is precipitated in the form of relatively coarse spherical carbide by virtue of an α/γ interface and undissolved carbide serving as nucleation sites. In this cooling, the cooling rate needs to be adjusted so as not to form pearlite. When the cooling rate after the first-stage annealing and before the second-stage annealing is less than 1° C./h, the production efficiency is poor. Thus, the cooling rate is 1° C./h or more. When the cooling rate is increased to more than 20° C./h, pearlite is precipitated to increase the hardness. Thus, the cooling rate is 20° C./h or less.

Holding at Temperature Lower than $Ar_1$ Transformation Point for 20 Hours or More (Second-Stage Annealing)

After the first-stage annealing, the steel sheet is cooled at a predetermined cooling rate and held at a temperature lower than the $Ar_1$ transformation point. Thereby, the coarse spherical carbide is further grown through Ostwald growth to allow fine carbide to disappear. When the holding time at a temperature lower than the $Ar_1$ transformation point is less than 20 hours, carbide cannot be sufficiently grown, thereby resulting in excessively high hardness after the annealing. Thus, in the second-stage annealing, the steel sheet is held at a temperature lower than the $Ar_1$ transformation point for 20 hours or more. The second-stage annealing temperature is preferably, but not necessarily, 660° C. or higher for the purpose of sufficiently grow carbide. The holding time is preferably, but not necessarily, 30 hours or less in view of production efficiency.

The $Ac_3$ transformation point, the $Ac_1$ transformation point, the $Ar_3$ transformation point, and the $Ar_1$ transformation point can be determined by actual measurement of thermal expansion measurement or electric resistance measurement during heating or cooling, by, for example, Formaster testing.

EXAMPLES

Steels A to U having component compositions presented in Table 1 were smelted. Subsequently, hot rolling was performed according to production conditions presented in Table 2. Then pickling was performed. Annealing (spheroidizing annealing) was performed at annealing temperatures and annealing times (h) presented in Tables 2 and 3 in a nitrogen atmosphere (atmosphere gas: nitrogen) to produce hot-rolled steel sheets having a thickness of 3.0 mm.

Test pieces were taken from the hot-rolled steel sheets obtained as above. The microstructure, the amount of dissolved Cr, the hardness, the elongation, and the quenching hardness were determined as described below. The $Ac_3$ transformation point, the $Ac_1$ transformation point, the $Ar_1$ transformation point, the $Ar_3$ transformation point described in Table 1 were determined by Formaster testing.

(1) Microstructure

Microstructures of the annealed steel sheets were determined as follows: A test piece (size: 3 mm thick×10 mm×10 mm) was taken from the middle portion of each sheet in the width direction, cut, polished, and subjected to nital etching. Images were captured with a scanning electron microscope (SEM) at five points in the middle portion of the sheet in the thickness direction at a magnification of 3,000×. The captured microstructure images were subjected to image processing to identify individual phases (ferrite, cementite, pearlite, and so forth).

The SEM images were binarized into ferrite and a region other than ferrite using image analysis software, and the area percentage of ferrite was determined.

The diameter of each cementite grain in the captured microstructure images was evaluated. The cementite diameter was determined by measuring the major axis and the minor axis and converting them into an equivalent circular diameter. The number of cementite grains having an equivalent circular diameter of 0.1 μm or less was measured and defined as the number of cementite grains having an equivalent circular diameter of 0.1 μm or less. The number of all cementite grains was determined and defined as the total number of cementite grains. The percentage of the number of cementite grains having an equivalent circular diameter of 0.1 μm or less based on the total number of cementite grains ((number of cementite grains having equivalent circular diameter of 0.1 μm or less/total number of cementite grains)×100(%)) was determined. The "percentage of the number of cementite grains having an equivalent circular diameter of 0.1 μm or less" may also be referred to simply as "cementite grains having an equivalent circular diameter of 0.1 μm or less".

The average grain size of ferrite in the captured microstructure images was determined by a method for evaluating grain size specified in JIS G 0551 (cutting method)

(2) Measurement of Amount of Dissolved Cr

The amount of dissolved Cr was determined by the same method as described in the following reference.

REFERENCE

Satoshi Kinoshiro, Tomoharu Ishida, Kunio Inose, and Kyoko Fujimoto, Tetsu-to-Hagane (Iron and Steel), vol. 99 (2013) No. 5, pp. 362-365.

(3) Hardness of Steel Sheet

A sample was taken from the middle portion of each annealed steel sheet (original sheet) in the width direction. Measurement was performed at five points on surface layers with a Rockwell hardness tester (B scale). The average of the measurements was determined and defined as the hardness (HRB).

(4) Elongation of Steel Sheet

A JIS No. 5 tensile test piece was cut out from each annealed steel sheet (original sheet) in a direction (L direction) of 0° to the rolling direction. A tensile test was performed using the test piece at 10 mm/min. The total elongation was determined by bringing the broken samples into contact with each other. The result was defined as the total elongation (El).

(5) Hardness of Steel Sheet after Quenching (Immersion Quenching Property)

A flat plate test piece (15 mm wide×40 mm long×3 mm thick) was taken from the middle portion of each annealed steel sheet in the width direction and subjected to quenching treatment by cooling with oil having a temperature of 70° C. The quenching hardness (immersion quenching properties) was determined. The quenching treatment was performed by a method in which the flat plate test piece was held at 900° C. for 600 seconds and immediately cooled with oil having a temperature of 70° C. (70° C.—oil cooling). The quenching hardness was determined as follows: On a cut surface of the test piece after the quenching treatment, the hardness was measured at five points of a ¼ position of the sheet thickness and the middle portion of the sheet in the thickness direction with a Vickers hardness tester at a load of 1 kgf. The average hardness was determined and defined as the quenching hardness (HV).

(6) Hardness of Steel Sheet after Carburizing and Quenching (Carburizing and Quenching Property)

Each annealed steel sheet was subjected to carburizing and quenching treatment including soaking of steel, carburizing treatment, and diffusion treatment at 930° C. for a total time of 4 hours, held at 850° C. for 30 minutes, and oil-cooled (oil-cooling temperature: 60° C.). The hardness was measured from a position 0.1 mm deep to a position 1.2 mm deep from a surface of the steel sheet at intervals of 0.1 mm at a load of 1 kgf. The hardness (HV) at 0.1 mm under the surface layer and the effective hardening penetration (mm) after the carburizing and quenching were determined. The effective hardening penetration is defined as a depth at which a hardness of 550 HV or more is achieved when the hardness is measured from the surface after heat treatment.

From the results obtained from the above (5) and (6), the hardenability was evaluated under conditions present in Table 4. Table 4 presents acceptance criteria of quenching that can be evaluated as sufficient quenching in accordance with the C content. When all of the hardness (HV) after oil cooling at 70° C., the hardness (HV) at 0.1 mm under the surface layer after the carburizing and quenching, and the effective hardening penetration satisfied the criteria described in Table 4, the steel sheet was determined to be acceptable (indicated by the symbol ○) and evaluated as having good hardenability. When any of the values did not satisfy the criteria described in Table 4, the steel sheet was determined to be unacceptable (indicated by the symbol x) and evaluated as having poor hardenability.

TABLE 1

| Steel No. | Component composition (% by mass) | | | | | | | | | | |
|---|---|---|---|---|---|---|---|---|---|---|---|
| | C | Si | Mn | P | S | sol. Al | N | Cr | B | Ti | Sb, Sn |
| A | 0.15 | 0.4 | 0.40 | 0.02 | 0.004 | 0.005 | 0.0044 | 0.25 | 0.0030 | — | — |
| B | 0.14 | 0.25 | 0.35 | 0.01 | 0.003 | 0.005 | 0.0041 | 0.15 | 0.0030 | — | Sb:0.010 |
| C | 0.15 | 0.25 | 0.40 | 0.01 | 0.003 | 0.006 | 0.0045 | 0.00 | 0.0020 | — | Sb:0.015 |
| D | 0.14 | 0.2 | 0.35 | 0.01 | 0.003 | 0.010 | 0.0050 | 0.15 | 0.0025 | 0.02 | — |
| E | 0.18 | 0.5 | 0.35 | 0.02 | 0.004 | 0.010 | 0.0044 | 0.35 | 0.0020 | 0.05 | Sb + Sn:0.0050 |
| F | 0.14 | 0.01 | 0.55 | 0.01 | 0.003 | 0.040 | 0.0055 | 0.50 | 0.0025 | 0.01 | Sb:0.025 |
| G | 0.17 | 0.24 | 0.35 | 0.02 | 0.004 | 0.020 | 0.0044 | 0.15 | 0.0001 | — | — |
| H | 0.19 | 0.01 | 0.20 | 0.02 | 0.003 | 0.050 | 0.0047 | 0.35 | 0.0020 | — | Sb + Sn:0.015 |
| I | 0.18 | 0.6 | 0.40 | 0.02 | 0.003 | 0.010 | 0.0047 | 0.45 | 0.0025 | 0.02 | Sb:0.005 |
| J | 0.10 | 0.25 | 0.35 | 0.02 | 0.004 | 0.005 | 0.0050 | 0.15 | 0.0019 | — | Sn + Sb:0.012 |
| K | 0.12 | 0.3 | 0.30 | 0.01 | 0.004 | 0.010 | 0.0044 | 0.18 | 0.0025 | — | Sb:0.009 |
| L | 0.14 | 0.15 | 0.35 | 0.01 | 0.003 | 0.035 | 0.0052 | 0.15 | 0.0030 | — | Sb:0.010 |
| M | 0.13 | 0.22 | 0.36 | 0.01 | 0.003 | 0.006 | 0.0047 | 0.15 | 0.0025 | — | Sb:0.009 |
| N | 0.14 | 0.28 | 0.25 | 0.01 | 0.003 | 0.040 | 0.0047 | 0.20 | 0.0015 | 0.04 | Sb:0.011 |
| O | 0.08 | 0.29 | 0.35 | 0.01 | 0.004 | 0.035 | 0.0050 | 0.13 | 0.0020 | — | Sb:0.010 |
| P | 0.25 | 0.4 | 0.50 | 0.01 | 0.003 | 0.040 | 0.0050 | 0.45 | 0.0020 | — | Sb:0.010 |
| Q | 0.14 | 0.01 | 0.55 | 0.01 | 0.003 | 0.040 | 0.0055 | 0.50 | 0.0025 | 0.01 | Sb:0.025 |
| R | 0.10 | 0.25 | 0.35 | 0.02 | 0.004 | 0.005 | 0.0050 | 0.15 | 0.0019 | — | Sn + Sb:0.012 |
| S | 0.12 | 0.3 | 0.30 | 0.01 | 0.004 | 0.010 | 0.0044 | 0.18 | 0.0025 | — | Sb:0.009 |
| T | 0.14 | 0.15 | 0.35 | 0.01 | 0.003 | 0.035 | 0.0052 | 0.15 | 0.0030 | — | Sb:0.010 |
| U | 0.13 | 0.22 | 0.36 | 0.01 | 0.003 | 0.006 | 0.0047 | 0.15 | 0.0025 | — | Sb:0.009 |

TABLE 1-continued

| Steel No. | Nb | Mo | Ta | Ni | Cu | V | W | $Ac_1$ transformation point (° C.) | $Ar_1$ transformation point (° C.) | $Ac_3$ transformation point (° C.) | $Ar_3$ transformation point (° C.) | Remarks |
|---|---|---|---|---|---|---|---|---|---|---|---|---|
| A | | | | | | | | 735 | 720 | 863 | 851 | Inventive steel |
| B | | | | | | | | 729 | 714 | 855 | 842 | Inventive steel |
| C | | | | | | | | 726 | 712 | 853 | 840 | Comparative steel |
| D | | | | | | | | 728 | 713 | 863 | 850 | Inventive steel |
| E | | | | | | | | 740 | 725 | 882 | 870 | Inventive steel |
| F | | | | | | | | 726 | 712 | 851 | 839 | Inventive steel |
| G | | | | | | | | 729 | 713 | 860 | 847 | Comparative steel |
| H | | | | | | | | 727 | 712 | 858 | 846 | Comparative steel |
| I | | | | | | | | 744 | 730 | 864 | 852 | Comparative steel |
| J | | | | | | | | 729 | 716 | 873 | 861 | Inventive steel |
| K | | | | | | | | 732 | 717 | 865 | 853 | Inventive steel |
| L | | | | | | | | 726 | 711 | 862 | 850 | Inventive steel |
| M | | | | | | | | 728 | 713 | 856 | 844 | Inventive steel |
| N | | | | | | | | 732 | 718 | 872 | 860 | Inventive steel |
| O | | | | | | | | 730 | 715 | 887 | 875 | Comparative steel |
| P | | | | | | | | 737 | 722 | 841 | 829 | Comparative steel |
| Q | 0.0010 | | | | | | | 726 | 712 | 851 | 839 | Inventive steel |
| R | | 0.0010 | | | | | | 729 | 716 | 873 | 861 | Inventive steel |
| S | | | | 0.0200 | | | | 732 | 717 | 865 | 853 | Inventive steel |
| T | | | 0.0010 | | 0.0200 | | | 726 | 711 | 862 | 850 | Inventive steel |
| U | | | | | | 0.0010 | 0.0010 | 728 | 713 | 856 | 844 | Inventive steel |

Note:
Underlined values are outside the range of the present invention.

TABLE 2

| Sample No. | Steel No. | Hot-rolling condition: Finishing temperature (° C.) | Hot-rolling condition: Average cooling rate to 700° C. after finish rolling (° C./sec) | Hot-rolling condition: Coiling temperature (° C.) | Annealing condition Annealing (annealing temperature-holding time) | Microstructure | [(Cementite with equivalent circular diameter of 0.1 μm or less)/(total cementite)] × 100 (%) | Average ferrite grain size (μm) | Area percentage of ferrite (%) | Amount of dissolved Cr (%) |
|---|---|---|---|---|---|---|---|---|---|---|
| 1 | A | 870 | 50 | 680 | 715° C.-30 h | ferrite + cementite | 10 | 7 | 95 | 0.13 |
| 2 | B | 865 | 60 | 620 | 715° C.-30 h | ferrite + cementite | 9 | 6 | 94 | 0.12 |
| 3 | B | 865 | 30 | 620 | 750° C.-30 h | ferrite + cementite + pearlite | 5 | 9 | 83 | 0.12 |
| 4 | C | 870 | 50 | 620 | 715° C.-30 h | ferrite + cementite | 7 | 9 | 95 | 0.00 |
| 5 | D | 870 | 60 | 680 | 710° C.-25 h | ferrite + cementite | 12 | 8 | 94 | 0.08 |
| 6 | E | 890 | 100 | 590 | 710° C.-25 h | ferrite + cementite | 9 | 7 | 94 | 0.20 |
| 7 | E | 890 | 50 | 450 | 670° C.-25 h | ferrite + cementite | 20 | 6 | 94 | 0.17 |
| 8 | F | 865 | 40 | 600 | 710° C.-25 h | ferrite + cementite | 10 | 7 | 94 | 0.25 |
| 9 | G | 870 | 60 | 600 | 710° C.-25 h | ferrite + cementite | 8 | 7 | 94 | 0.07 |

TABLE 2-continued

| | | | | | | | | | | |
|---|---|---|---|---|---|---|---|---|---|---|
| 10 | H | 880 | 50 | 660 | 715° C.-30 h | ferrite + cementite | 11 | 7 | 94 | 0.25 |
| 11 | I | 875 | 50 | 660 | 715° C.-30 h | ferrite + cementite | 9 | 8 | 94 | 0.23 |
| 12 | J | 895 | 50 | 600 | 715° C.-30 h | ferrite + cementite | 8 | 6 | 93 | 0.07 |
| 13 | K | 880 | 20 | 590 | 715° C.-30 h | ferrite + cementite | 7 | 5 | 95 | 0.15 |
| 14 | L | 870 | 25 | 590 | 715° C.-30 h | ferrite + cementite | 8 | 6 | 93 | 0.07 |
| 15 | M | 860 | 50 | 650 | 715° C.-30 h | ferrite + cementite | 9 | 6 | 94 | 0.07 |
| 16 | N | 870 | 40 | 700 | 715° C.-30 h | ferrite + cementite | 9 | 8 | 94 | 0.23 |
| 17 | O | 890 | 40 | 650 | 715° C.-30 h | ferrite + cementite | 8 | 7 | 95 | 0.07 |
| 18 | P | 890 | 40 | 600 | 715° C.-30 h | ferrite + cementite | 12 | 5 | 91 | 0.20 |
| 32 | Q | 865 | 50 | 620 | 710° C.-25 h | ferrite + cementite | 12 | 6 | 94 | 0.25 |
| 33 | R | 895 | 50 | 600 | 715° C.-30 h | ferrite + cementite | 9 | 5 | 92 | 0.07 |
| 34 | S | 880 | 25 | 590 | 715° C.-30 h | ferrite + cementite | 8 | 5 | 95 | 0.15 |
| 35 | T | 870 | 30 | 590 | 715° C.-30 h | ferrite + cementite | 9 | 7 | 93 | 0.07 |
| 36 | U | 860 | 45 | 650 | 715° C.-30 h | ferrite + cementite | 10 | 7 | 94 | 0.07 |

| | | | Immersion quenching property (HV) | | Carburizing and quenching property | | | |
|---|---|---|---|---|---|---|---|---|
| Sample No. | Hardness (HRB) | Elongation (%) | Oil cooling at 70° C. (1/4 thickness) | Oil cooling at 70° C. (middle portion of sheet thickness) | Hardness at 0.1 mm under surface layer after carburizing and quenching (HV) | Effective hardening penetration after carburizing and quenching (mm) | Hardenability evaluation | Remarks |
| 1 | 73 | 39 | 385 | 386 | 640 | 0.70 | ○ | Example |
| 2 | 70 | 40 | 375 | 375 | 680 | 0.60 | ○ | Example |
| 3 | 76 | 35 | 377 | 375 | 685 | 0.75 | ○ | Comparative example |
| 4 | 68 | 42 | 386 | 386 | 510 | 0.55 | x | Comparative example |
| 5 | 70 | 40 | 376 | 377 | 680 | 0.60 | ○ | Example |
| 6 | 71 | 40 | 409 | 408 | 680 | 0.65 | ○ | Example |
| 7 | 74 | 36 | 410 | 410 | 680 | 0.65 | ○ | Comparative example |
| 8 | 69 | 42 | 373 | 374 | 660 | 0.70 | ○ | Example |
| 9 | 71 | 38 | 330 | 330 | 500 | 0.53 | x | Comparative example |
| 10 | 70 | 40 | 417 | 417 | 590 | 0.45 | x | Comparative example |
| 11 | 75 | 35 | 409 | 409 | 680 | 0.65 | ○ | Comparative example |
| 12 | 67 | 42 | 332 | 333 | 680 | 0.60 | ○ | Example |
| 13 | 70 | 40 | 353 | 353 | 670 | 0.47 | ○ | Example |
| 14 | 71 | 39 | 375 | 375 | 690 | 0.65 | ○ | Example |
| 15 | 72 | 39 | 365 | 364 | 690 | 0.70 | ○ | Example |
| 16 | 73 | 38 | 376 | 380 | 695 | 0.70 | ○ | Example |
| 17 | 68 | 42 | 280 | 295 | 600 | 0.40 | x | Comparative example |
| 18 | 74 | 36 | 450 | 455 | 600 | 0.70 | ○ | Comparative example |
| 32 | 70 | 41 | 375 | 376 | 665 | 0.70 | ○ | Example |
| 33 | 66 | 43 | 333 | 335 | 685 | 0.62 | ○ | Example |
| 34 | 70 | 40 | 355 | 356 | 675 | 0.49 | ○ | Example |
| 35 | 72 | 38 | 377 | 380 | 695 | 0.65 | ○ | Example |
| 36 | 71 | 40 | 370 | 372 | 700 | 0.70 | ○ | Example |

Note:

Underlined values are outside the range of the present invention.

TABLE 3

| Sample No. | Steel No. | Hot-rolling condition: Finishing temperature (° C.) | Hot-rolling condition: Average cooling rate to 700° C. after finish rolling (° C./sec) | Hot-rolling condition: Coiling temperature (° C.) | Annealing condition: First-stage annealing (annealing temperature-holding time) | Annealing condition: Average cooling rate from first stage to second stage (°C./h) | Annealing condition: Second-stage annealing (annealing temperature holding time) | Micro-structure | [(Cementite with equivalent circular diameter of 0.1 μm or less)/(total cementite)] × 100 (%) | Average ferrite grain size (μm) | Area percentage of ferrite (%) |
|---|---|---|---|---|---|---|---|---|---|---|---|
| 19 | A | 870 | 50 | 680 | 790° C.-6 h | 10 | 710° C.-30 h | ferrite + cementite | 1 | 15 | 95 |
| 20 | B | 865 | 60 | 670 | 780° C.-8 h | 10 | 710° C.-30 h | ferrite + cementite | 1 | 13 | 94 |
| 21 | B | 865 | 30 | 620 | 860° C.-8 h | 10 | 710° C.-30 h | ferrite + cementite + pearlite | 5 | 17 | 83 |
| 22 | B | 865 | 60 | 670 | 800° C.-6 h | 50 | 710° C.-30 h | ferrite+ cementite | 1 | 13 | 94 |
| 23 | C | 870 | 50 | 620 | 770° C.-8 h | 10 | 710° C.-20 h | ferrite + cementite | 1 | 12 | 95 |
| 24 | D | 870 | 60 | 680 | 790° C.-6 h | 8 | 710° C.-20 h | ferrite + cementite | 1 | 13 | 94 |
| 25 | E | 890 | 100 | 650 | 790° C.-4 h | 8 | 710° C.-25 h | ferrite + cementite | 1 | 10 | 94 |
| 26 | F | 865 | 40 | 600 | 770° C.-6 h | 10 | 710° C.-20 h | ferrite + cementite | 1 | 11 | 94 |
| 27 | J | 895 | 50 | 700 | 780° C.-8 h | 10 | 710° C.-30 h | ferrite + cementite | 1 | 12 | 93 |
| 28 | K | 880 | 20 | 690 | 780° C.-8 h | 10 | 710° C.-30 h | ferrite + cementite | 1 | 10 | 95 |
| 29 | L | 870 | 25 | 590 | 810° C.-6 h | 10 | 710° C.-30 h | ferrite + cementite | 1 | 11 | 93 |
| 30 | M | 860 | 50 | 650 | 810° C.-4 h | 10 | 710° C.-21 h | ferrite + cementite | 1 | 11 | 94 |
| 31 | N | 870 | 40 | 680 | 800° C.-6 h | 10 | 710° C.-25 h | ferrite + cementite | 1 | 12 | 94 |

| Sample No. | Amount of dissolved Cr (%) | Hardness (HRB) | Elongation (%) | Immersion quenching property (HV): Oil cooling at 70° C. (1/4 thickness) | Immersion quenching property (HV): Oil cooling at 70° C. (middle portion of sheet thickness) | Carburizing and quenching property: Hardness at 0.1 mm under surface layer after carburizing and quenching (HV) | Carburizing and quenching property: Effective hardening penetration after carburizing and quenching (mm) | Hardenability evaluation | Remarks |
|---|---|---|---|---|---|---|---|---|---|
| 19 | 0.13 | 69 | 42 | 383 | 380 | 640 | 0.71 | ○ | Example |
| 20 | 0.12 | 66 | 43 | 370 | 370 | 678 | 0.62 | ○ | Example |
| 21 | 0.12 | 72 | 35 | 375 | 374 | 686 | 0.76 | ○ | Comparative example |
| 22 | 0.12 | 72 | 35 | 371 | 372 | 677 | 0.63 | ○ | Comparative example |
| 23 | 0.00 | 65 | 43 | 386 | 386 | 510 | 0.55 | x | Comparative example |
| 24 | 0.08 | 67 | 41 | 377 | 380 | 681 | 0.60 | ○ | Example |
| 25 | 0.20 | 71 | 40 | 409 | 408 | 681 | 0.66 | ○ | Example |
| 26 | 0.25 | 65 | 43 | 374 | 375 | 661 | 0.72 | ○ | Example |
| 27 | 0.07 | 63 | 44 | 331 | 332 | 681 | 0.59 | ○ | Example |
| 28 | 0.15 | 66 | 43 | 354 | 354 | 669 | 0.46 | ○ | Example |
| 29 | 0.07 | 67 | 41 | 374 | 374 | 689 | 0.63 | ○ | Example |
| 30 | 0.07 | 68 | 41 | 364 | 363 | 689 | 0.69 | ○ | Example |
| 31 | 0.23 | 70 | 40 | 375 | 379 | 694 | 0.69 | ○ | Example |

Note:
Underlined values are outside the range of the present invention.

TABLE 4

| C content | Hardness after oil cooling at 70° C. (HV) | Hardness at 0.1 mm under surface layer after carburizing and quenching (HV) | Effective hardening penetration after carburizing and quenching (mm) |
|---|---|---|---|
| 0.15% ≤ C < 0.2% | ≥350 | ≥600 | ≥0.60 |
| 0.10% ≤ C < 0.15% | ≥300 | ≥600 | ≥0.40 |

The results presented in Tables 2 and 3 demonstrate that each of the high-carbon hot-rolled steel sheets of the examples has the microstructure in which the percentage of the number of cementite grains having an equivalent circular diameter of 0.1 μm or less is 12% or less based on the total number of cementite grains, the microstructure being composed of ferrite and cementite, the steel sheet having a hardness of 73 or less in terms of HRB, a total elongation (El) of 37% or more, good cold workability, and good hardenability. In contrast, in the comparative examples outside the scope of the present invention, any one or more of the microstructure, the hardness (HRB), the total elongation (El), the cold workability, and the hardenability cannot satisfy the above target performance. For example, steel 0 has a lower C content than the range according to aspects of the present invention and thus does not satisfy the immersion quenching properties. Steel P has a higher C content than the range according to aspects of the present invention and does not satisfy the hardness and elongation properties of the steel sheet.

The invention claimed is:

1. A high-carbon hot-rolled steel sheet, comprising a composition containing, on a percent by mass basis, C: 0.10% or more and 0.18% or less;

Si: 0.5% or less;

Mn: 0.25% to 0.65%;

P: 0.03% or less;

S: 0.010% or less;

sol. Al: 0.10% or less;

N: 0.0065% or less;

Cr: 0.05% to 0.50%; and

B: 0.0005% to 0.005%, the balance being Fe and incidental impurities, the high-carbon hot-rolled steel sheet having a microstructure containing ferrite and cementite, wherein a percentage of a number of cementite grains having an equivalent circular diameter of 0.1 μm or less is 12% or less based on a total number of the cementite grains, the amount of Cr dissolved in the steel sheet is, on a percent by mass basis, 0.03% to 0.50%, and the high-carbon hot-rolled steel sheet has a hardness of 73 or less in terms of HRB and a total elongation of 37% or more.

2. The high-carbon hot-rolled steel sheet according to claim 1, the composition further contains at least one selected from the following groups A to C consisting of:

Group A: on a percent by mass basis, Ti: 0.06% or less;

Group B: on a percent by mass basis, 0.002% to 0.03% in total of at least one of Sb and Sn; and Group C: on a percent by mass basis, one or two or more of Nb: 0.0005% to 0.1%, Mo: 0.0005% to 0.1%, Ta: 0.0005% to 0.1%, Ni: 0.0005% to 0.1%, Cu: 0.0005% to 0.1%, V: 0.0005% to 0.1%, and W: 0.0005% to 0.1%.

3. The high-carbon hot-rolled steel sheet according to claim 1, wherein the ferrite has an average grain size of 5 to 15 μm.

4. The high-carbon hot-rolled steel sheet according to claim 2, wherein the ferrite has an average grain size of 5 to 15 μm.

5. A method for producing a high-carbon hot-rolled steel sheet according to claim 1, comprising subjecting a steel to hot rough rolling and to finish rolling at a finishing temperature of Ara transformation point or higher to form a steel sheet, then cooling the steel sheet to 700° C. at an average cooling rate of 20 to 100° C./sec, coiling the steel sheet at a coiling temperature of higher than 580° C. to 700° C. and, after cooling to normal temperature, performing spheroidizing annealing of the steel sheet.

6. The method for producing a high-carbon hot-rolled steel sheet according to claim 5, wherein the spheroidizing annealing includes holding the steel sheet at a temperature lower than $Ac_1$ transformation point.

7. The method for producing a high-carbon hot-rolled steel sheet according to claim 5, wherein the spheroidizing annealing includes heating the steel sheet to a first-stage annealing temperature of $Ac_1$ transformation point or higher and $Ac_3$ transformation point or lower and holding the steel sheet at the first-stage annealing temperature for 0.5 hours or more, cooling the steel sheet to a temperature lower than $Ar_1$ transformation point at an average cooling rate of 1 to 20° C./h, and holding the steel sheet at a second-stage annealing temperature lower than the $Ar_1$ transformation point for 20 hours or more.

8. A method for producing a high-carbon hot-rolled steel sheet according to claim 2, comprising subjecting a steel to hot rough rolling and to finish rolling at a finishing temperature of $Ar_3$ transformation point or higher to form a steel sheet, then cooling the steel sheet to 700° C. at an average cooling rate of 20 to 100° C./sec, coiling the steel sheet at a coiling temperature of higher than 580° C. to 700° C. and, after cooling to normal temperature, performing spheroidizing annealing of the steel sheet.

9. The method for producing a high-carbon hot-rolled steel sheet according to claim 8, wherein the spheroidizing annealing includes holding the steel sheet at a temperature lower than $Ac_1$ transformation point.

10. The method for producing a high-carbon hot-rolled steel sheet according to claim 8, wherein the spheroidizing annealing includes heating the steel sheet to a first-stage annealing temperature of $Ac_1$ transformation point or higher and $Ac_3$ transformation point or lower and holding the steel sheet at the first-stage annealing temperature for 0.5 hours or more, cooling the steel sheet to a temperature lower than $Ar_1$ transformation point at an average cooling rate of 1 to 20° C./h, and holding the steel sheet at a second-stage annealing temperature lower than the $Ar_1$ transformation point for 20 hours or more.

11. A method for producing a high-carbon hot-rolled steel sheet according to claim 3, comprising subjecting a steel to hot rough rolling and to finish rolling at a finishing temperature of $Ar_3$ transformation point or higher to form a steel sheet, then cooling the steel sheet to 700° C. at an average cooling rate of 20 to 100° C./sec, coiling the steel sheet at a coiling temperature of higher than 580° C. to 700° C. and, after cooling to normal temperature, performing spheroidizing annealing of the steel sheet.

12. The method for producing a high-carbon hot-rolled steel sheet according to claim 11, wherein the spheroidizing annealing includes holding the steel sheet at a temperature lower than $Ac_1$ transformation point.

13. The method for producing a high-carbon hot-rolled steel sheet according to claim 11, wherein the spheroidizing annealing includes heating the steel sheet to a first-stage annealing temperature of $Ac_1$ transformation point or higher and $Ac_3$ transformation point or lower and holding the steel sheet at the first-stage annealing temperature for 0.5 hours or more, cooling the steel sheet to a temperature lower than $Ar_1$ transformation point at an average cooling rate of 1 to 20° C./h, and holding the steel sheet at a second-stage annealing temperature lower than the $Ar_1$ transformation point for 20 hours or more.

14. A method for producing a high-carbon hot-rolled steel sheet according to claim 4, comprising subjecting a steel to hot rough rolling and to finish rolling at a finishing temperature of $Ar_3$ transformation point or higher to form a steel sheet, then cooling the steel sheet to 700° C. at an average cooling rate of 20 to 100° C./sec, coiling the steel sheet at a coiling temperature of higher than 580° C. to 700° C. and, after cooling to normal temperature, performing spheroidizing annealing of the steel sheet.

15. The method for producing a high-carbon hot-rolled steel sheet according to claim 14, wherein the spheroidizing annealing includes holding the steel sheet at a temperature lower than $Ac_1$ transformation point.

16. The method for producing a high-carbon hot-rolled steel sheet according to claim 14, wherein the spheroidizing annealing includes heating the steel sheet to a first-stage annealing temperature of $Ac_1$ transformation point or higher and $Ac_3$ transformation point or lower and holding the steel sheet at the first-stage annealing temperature for 0.5 hours or more, cooling the steel sheet to a temperature lower than $Ar_1$ transformation point at an average cooling rate of 1 to 20° C./h, and holding the steel sheet at a second-stage annealing temperature lower than the $Ar_1$ transformation point for 20 hours or more.

* * * * *